US008250697B2

(12) United States Patent
Lee et al.

(10) Patent No.: US 8,250,697 B2
(45) Date of Patent: Aug. 28, 2012

(54) AUTOMATED CABLE HANDLING AND CLEANING SYSTEM

(75) Inventors: Robin Lee, Hamburg, NJ (US); Marc Palmer, North Bergen, NJ (US)

(73) Assignee: Production Resource Group, LLC, New Windsor, NY (US)

( * ) Notice: Subject to any disclaimer, the term of this patent is extended or adjusted under 35 U.S.C. 154(b) by 1178 days.

(21) Appl. No.: 11/843,396

(22) Filed: Aug. 22, 2007

(65) Prior Publication Data

US 2008/0047083 A1 Feb. 28, 2008

Related U.S. Application Data

(60) Provisional application No. 60/839,756, filed on Aug. 23, 2006.

(51) Int. Cl.
*B08B 1/02* (2006.01)
*B08B 9/02* (2006.01)

(52) U.S. Cl. ..... 15/104.04; 15/88.1; 15/88.2; 15/88.3

(58) Field of Classification Search ..... 198/339.1; 15/88.1–88.3
See application file for complete search history.

(56) References Cited

U.S. PATENT DOCUMENTS

| | | | | |
|---|---|---|---|---|
| 3,641,970 | A * | 2/1972 | Brekle | 118/672 |
| 4,348,781 | A * | 9/1982 | Wahlstrom et al. | 15/40 |
| 4,503,577 | A * | 3/1985 | Fowler | 15/88 |
| 4,591,390 | A * | 5/1986 | Scott et al. | 134/15 |
| 5,056,185 | A * | 10/1991 | Schotter | 15/302 |
| 5,237,716 | A * | 8/1993 | Lisec | 15/77 |
| 5,356,480 | A * | 10/1994 | Melgeorge | 134/15 |
| 2007/0151831 | A1 * | 7/2007 | Le Borgne | 198/860.1 |

* cited by examiner

*Primary Examiner* — Monica Carter
*Assistant Examiner* — Stephanie Newton
(74) *Attorney, Agent, or Firm* — Law Office of Scott C. Harris, Inc.

(57) ABSTRACT

A cable processing system includes a conveyor that holds cables and conveys the cables in a specified direction. The operation stretches the cables and allows them to be packaged or otherwise coiled. The cable processing system may wash the cables as they pass thereby.

24 Claims, 16 Drawing Sheets

AUTOMATED CABLE HANDLING AND CLEANING SYSTEM

CROSS-REFERENCE TO RELATED APPLICATIONS

This application claims priority to U.S. Provisional Application Ser. No. 60/839,756, filed on Aug. 23, 2006. The disclosure of the prior application is considered part of (and is incorporated by reference in) the disclosure of this application.

BACKGROUND

Show venues, such as concerts, Broadway shows, or the like, often use many cables which need to be extended to various places at the venue. The cables may carry control signals, power, and the like. Because the items which require the power may be very far from the controlling deck and/or the source of power, those cables must be correspondingly long. However, other cables are shorter.

The venue is often wired by a wiring contractor, e.g., a stage rental company. After the venue is completed, the cables are returned to the rental company. The wires are then bundled and sorted.

This has typically been done by manually pulling the cables, and then bundling the cables onto either a spindle or into a bundle.

SUMMARY

The present application teaches an automated cable handling system that automatically processes the cable.

Aspects include parts that clean the cable during the operation. Another aspect includes a part that automatically monitors the cable type and length, thereby sorting the cable automatically.

DETAILED DESCRIPTION

The general structure and techniques, and more specific embodiments which can be used to effect different ways of carrying out the more general goals, are described herein.

The present application describes an automatic cable handling system, which allows automated processing of the cable.

One of the issues found with cable handling in the prior art is that the cable was effectively stretched across a work floor. This stretching and the subsequent coiling was done manually, and required significant manual effort. The cables laid across the floor, hence causing a hazard. Moreover, the cables got very dirty during their time on the floor. The stretched cables were then bundled up.

Embodiments address these issues.

One aspect of this application cleans the cable while the cable is being conveyed. A cable clamp holds various sizes of cable, conveying the cable along a conveyor.

Figure 1:
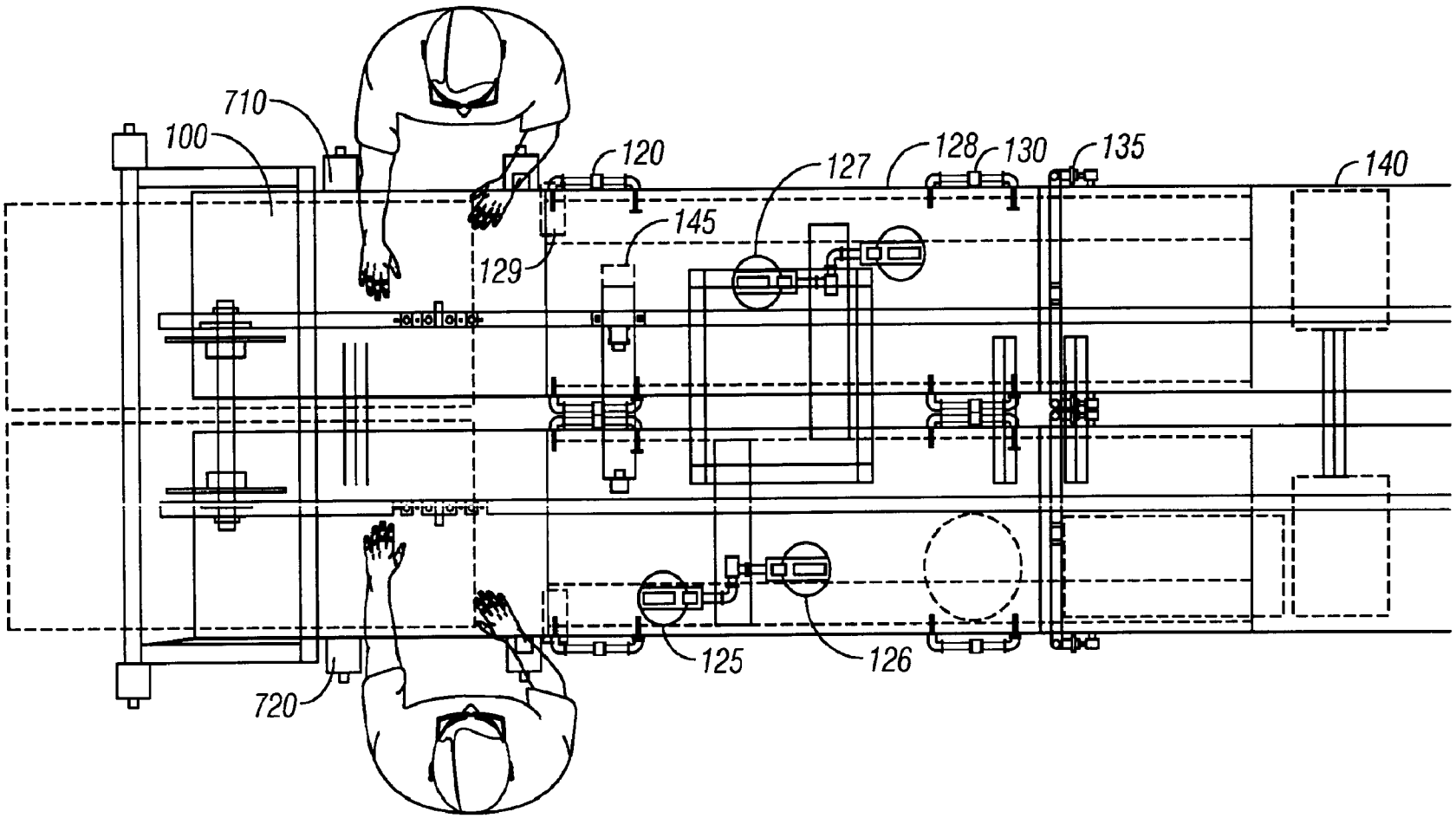
FIGS. 1 through 3 show the input area of the conveyance path.

In operation, the cable is first sorted by type. The cable sorting may be done on a dock or other table. The cables may then be sent, for example, to the input stage of the conveyor shown in FIGS. 1-3. The cables are initially placed in cable holders such as 145. The cable holders move along a support, forming the conveyance path in the direction of arrow 105. Cable clamp 145 holds the cables as they are moved. The cable clamps 145, 155 may be located on the support 160 every 20 feet, for example; see FIG. 2. The clamps are driven to move in a continuous loop, so that clamps such as 145 are driven in a first direction to stretch the cable, and 150 is driven in a second direction to return the clamp back to the cable-initiation point at which point a new cable can be attached and stretched.

After attachment, the cables are first conveyed to a soap and water wash spot, which may include a presoak area 129 which presoaks the cables. The cables are then each washed by brushes. Brushes 125, 126 are shown for a first cable, and 127, 128 for a second cable. It should be understood that there may be other brushes in other locations.

The cables are then rinsed with water or solvent in a rinse area 130. Water is blown off the cables at 135 by an air blower device.

Figure 2:
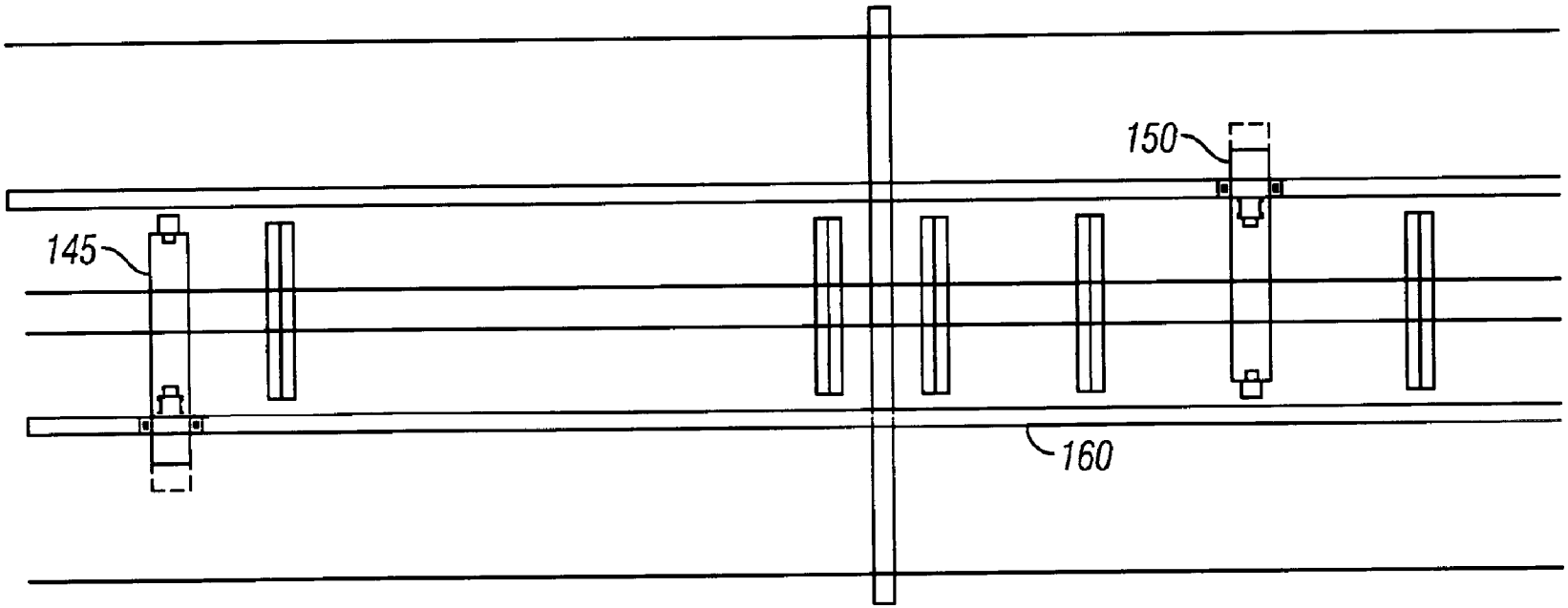

The cables pass through area 140, held by the cable clamp/grippers 145 in FIG. 2. This shows a second area of the conveyor, along which the cables are allowed to dry, and/or blown off. In the embodiment, the cable grippers may be located on 20 foot centers.

Figure 3:
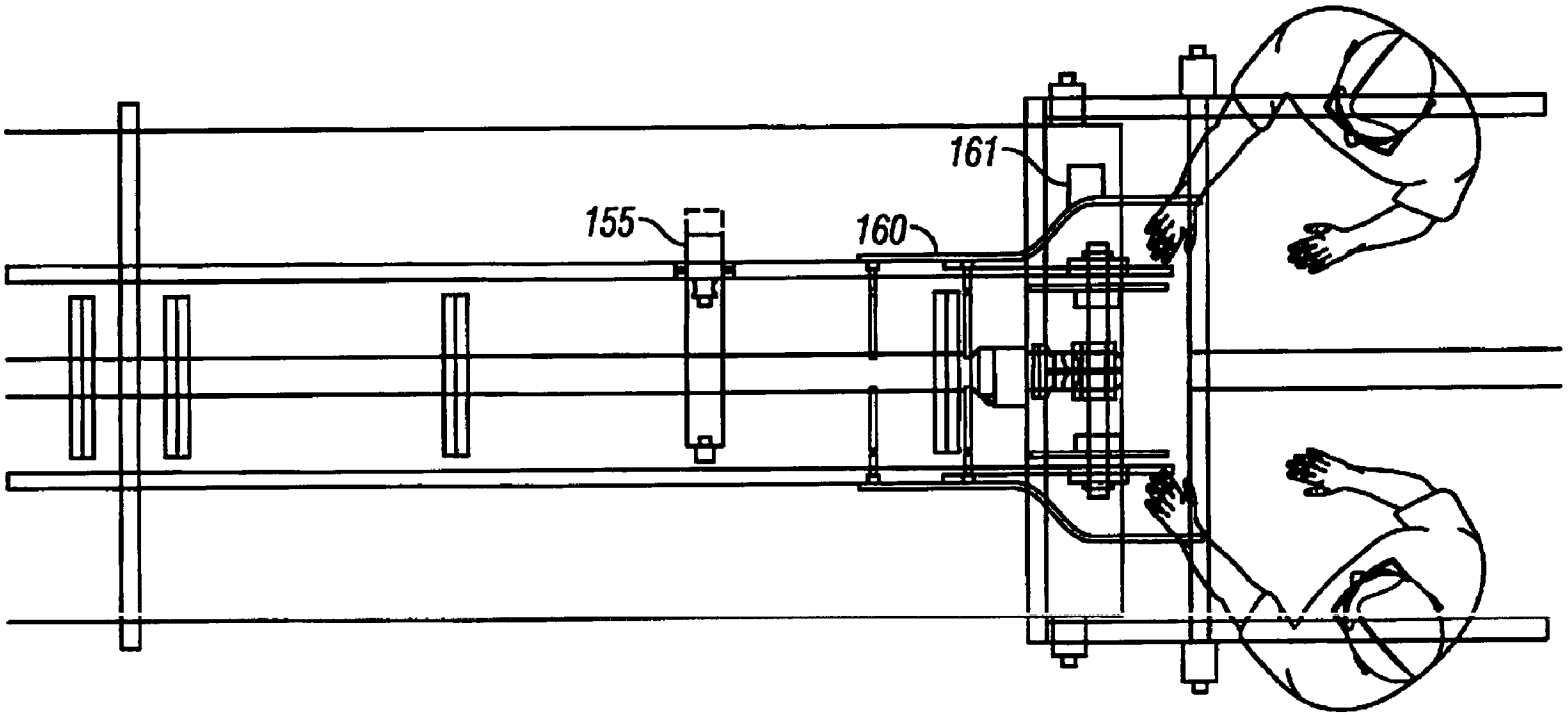

The cable continues being conveyed to the section of FIG. 3. The cable is then passed to a bundler 130, which rotates a wrapper 160, for example, to bundle the cables into any desired configuration, such as bundles or spools. The wrapper 160 may also include a label printer 161 which automatically affixes information indicative of the cables. For example, this can be an inventory number or the like to facilitate the tracking.

Since the conveyance path is along a support, the conveyance surface can be open, to allow foreign objects such as dirt and liquid, to fall off. This is different than a belt style conveyance, in which all dirt and foreign objects would fall on the belt, for example.

Figure 4A:
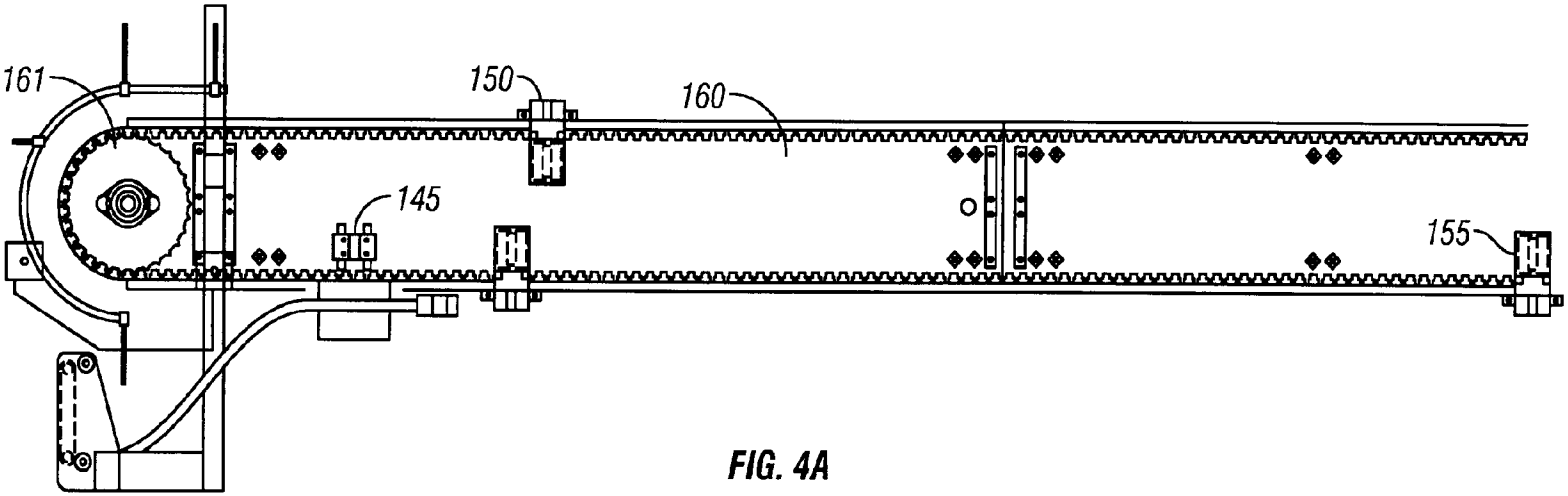
FIGS. 4A through 6 show a side view of the conveyor and conveyance path.

A side view of the conveyor is shown in FIGS. 4A-6. FIG. 4A illustrates the conveyor support including the cable grippers 145, 150, 155 and other structures. 145 is conveying a cable in the direction of stretching, 150 is a cable clamp that is returning back toward the origin. The returning clamp 150 is conveyed around a curved support area 161, after which it is ready to receive another cable.

Figure 4B:
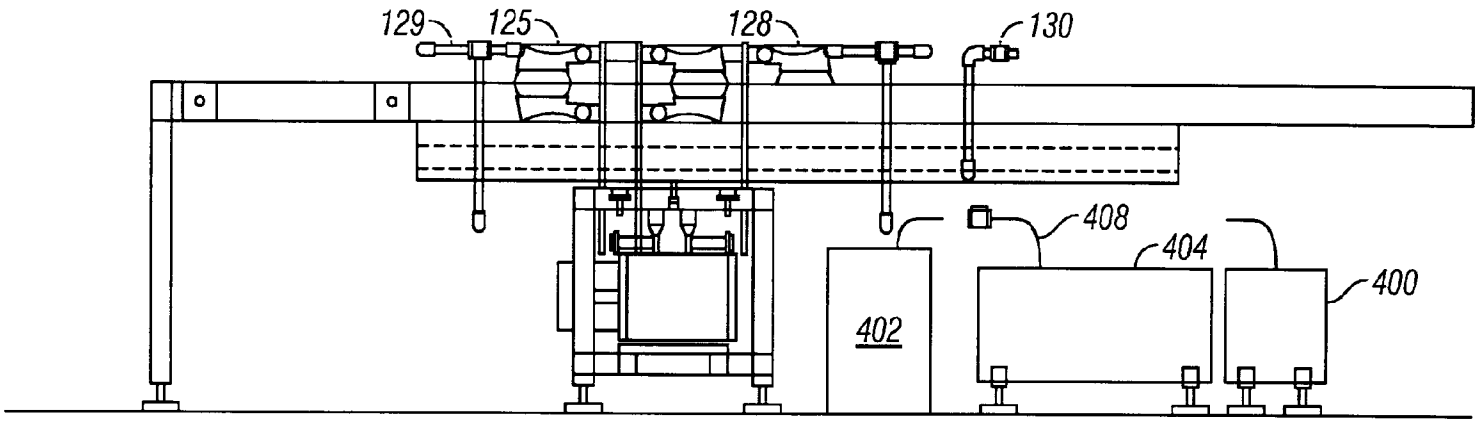

FIG. 4B shows another view of the conveyance path, which shows the different stations, including the presoak station 129, the rollers 125, 126, the rinse station 128, and the air blower station 130. The different structures which hold the washing material are also shown. FIG. 4B, for example, shows the fresh water tank 400, soap concentrate held in receptacle 402, and also shows a soap drain tank 404 for receiving the dirty water. Input 408 represents an air compressor, for the air blower 130.

The area under the conveyance path, in the area of washing and rinsing, is preferably a mesh structure, e.g., a metal mesh.

Figure 5A:
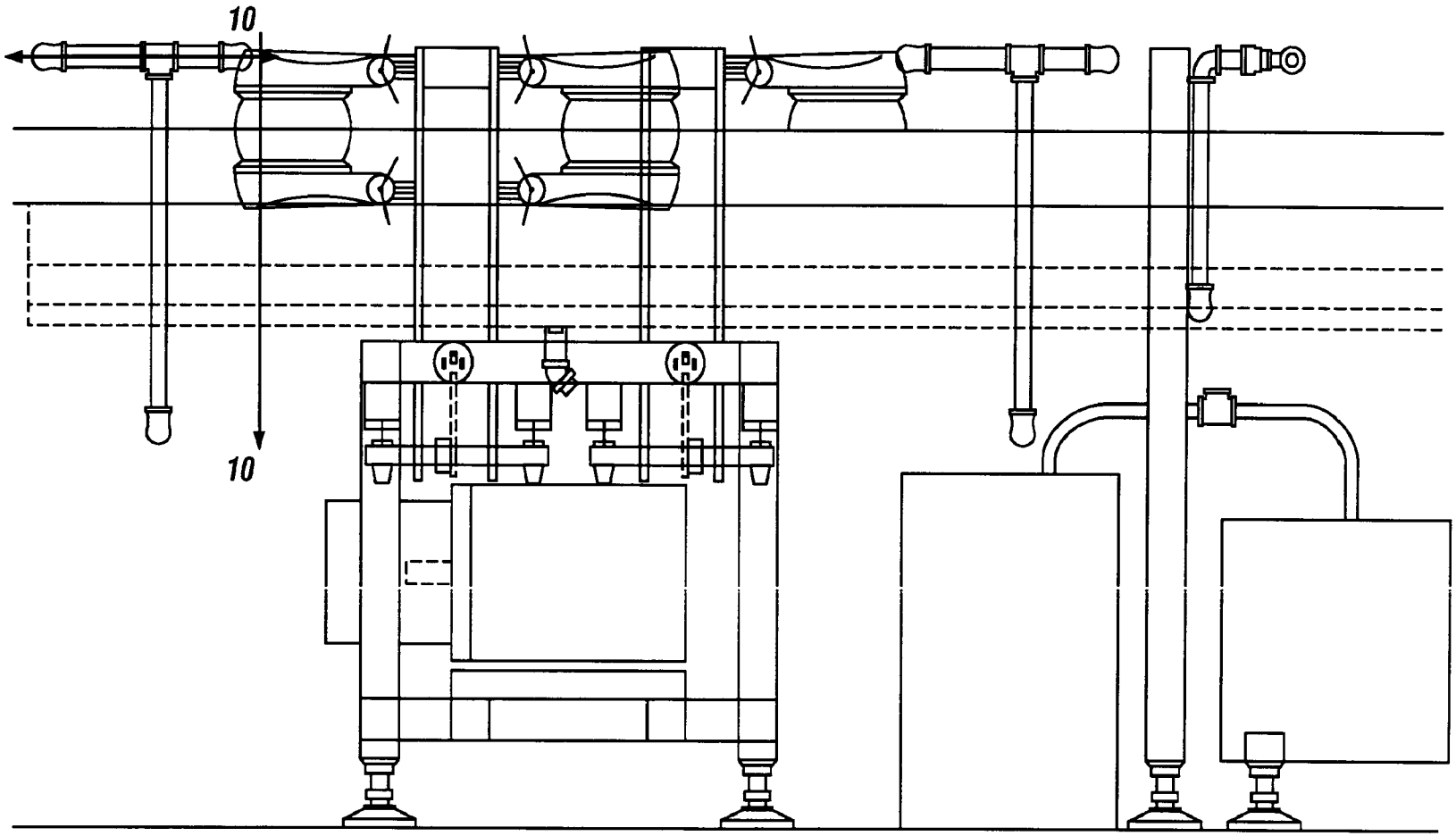

FIG. 5A illustrates a close-up of the different structure including the presoak, brushes, and the motor. FIG. 5C shows a perspective view with presoak, rinses and drying, as well as the brushes.

Figure 5B:
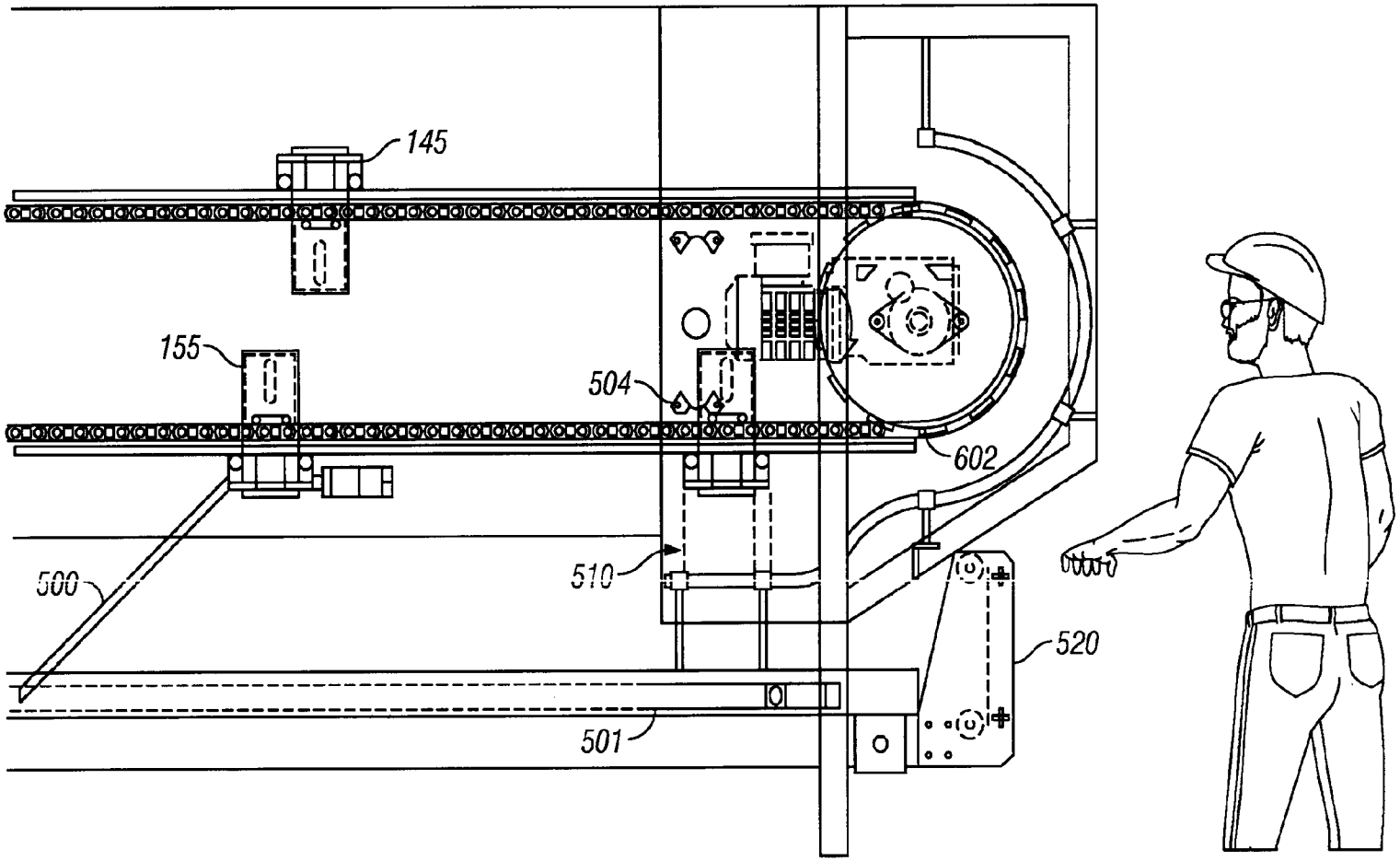
Figure 5C:
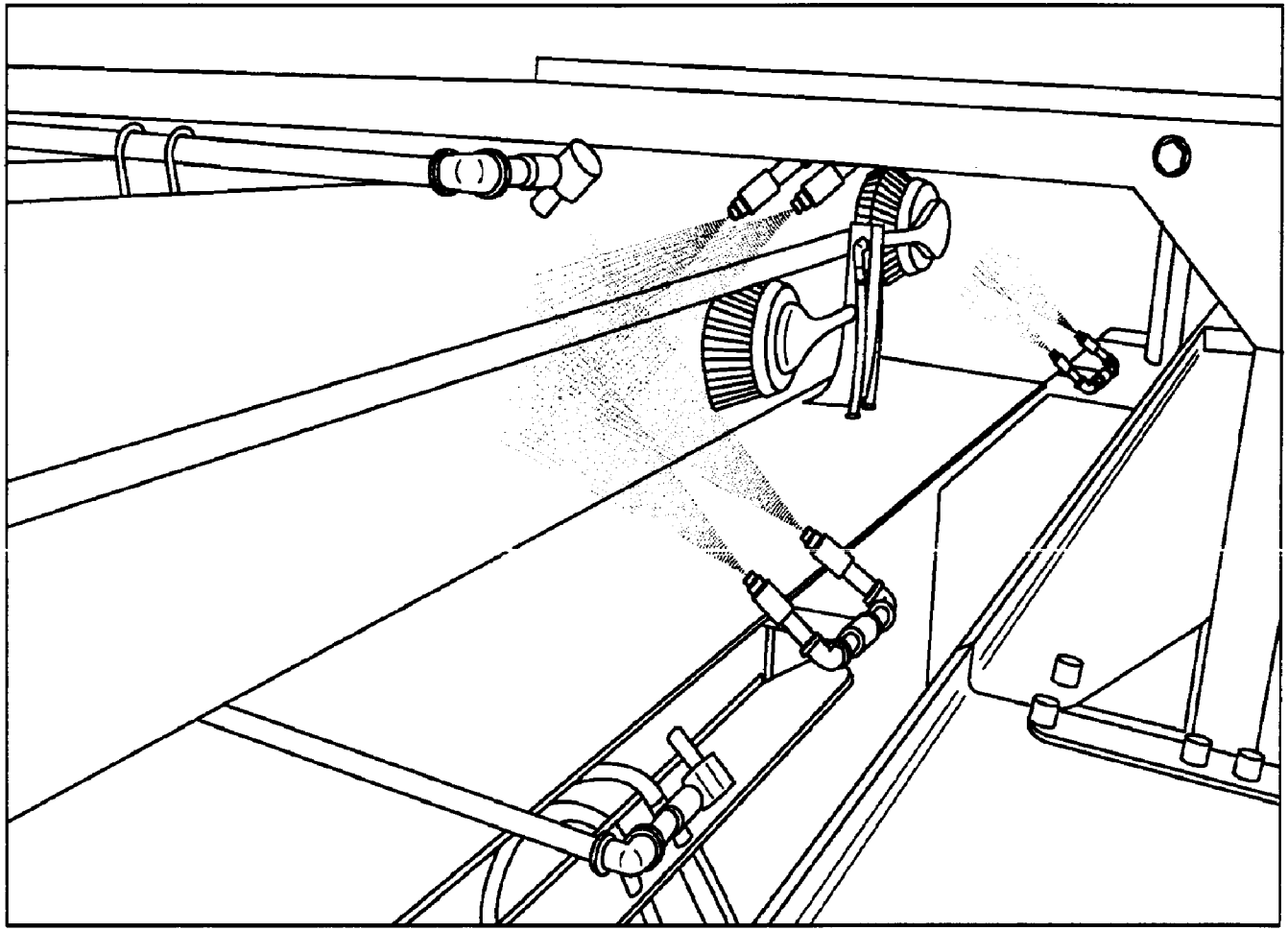

FIG. 5B illustrates the end part of the conveyance path. Note that the clamp 155 is holding the cables such as cable 500. At degrip zone 510, the cables are released from their clamps. This may be automatically done when sensing the position of a mechanical part 504. The cable 501, once so released, may be loaded onto a desired caddie for coiling. A roller device 520 may also be provided, to facilitate rolling up bundles of cable.

FIG. 5B also illustrates the second end portion 602 of the support 600, in which the clamps such as 145 are turned around to be returned to the origin.

Since these cables are heavy and bulky, an important feature is the emergency switch. An emergency off switch 530 is located within the reach of each operator.

Figure 6:
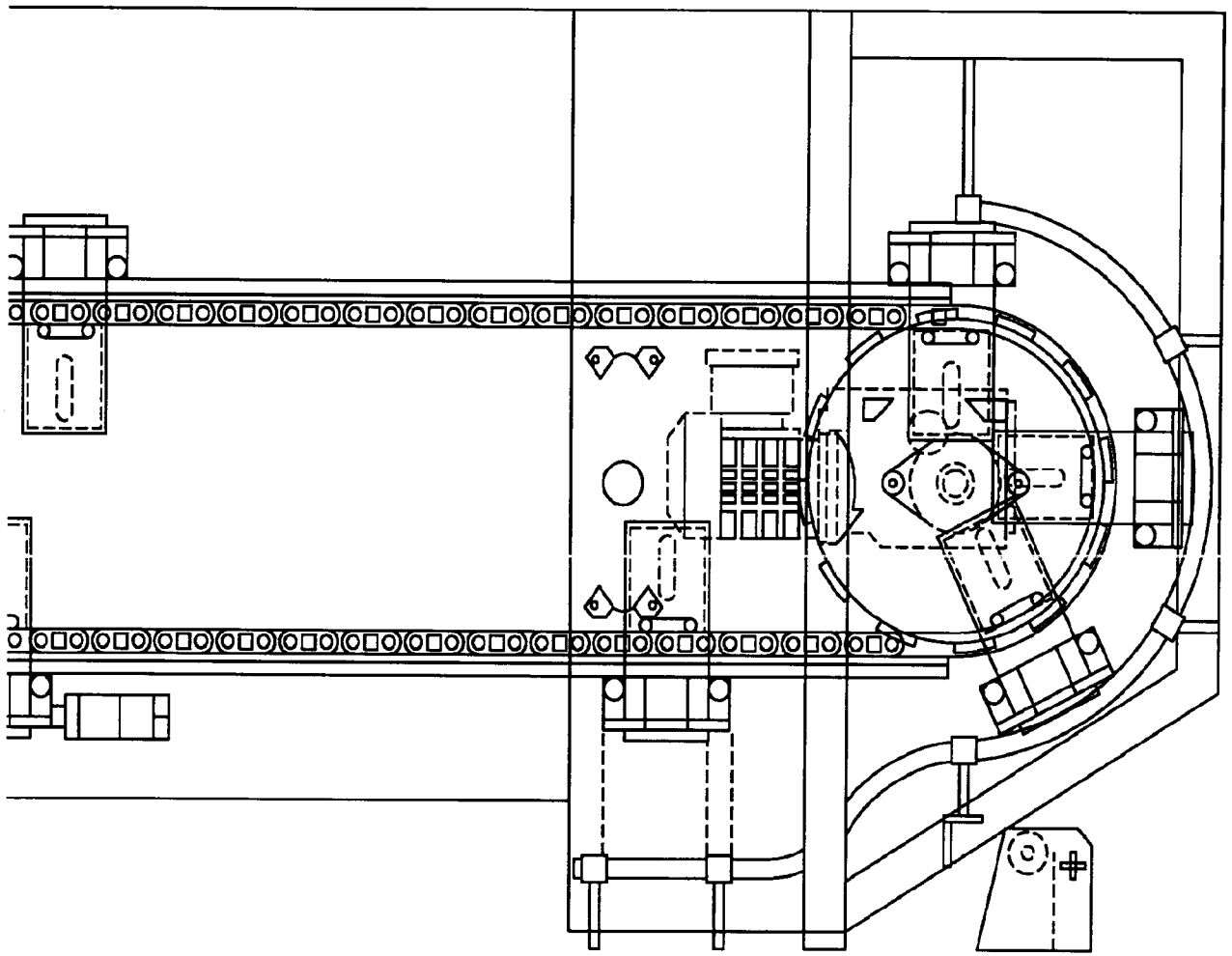

FIG. 6 shows an alternative view of the FIG. 5 embodiment, showing how the cables can be released from the different grippers.

Figure 7:
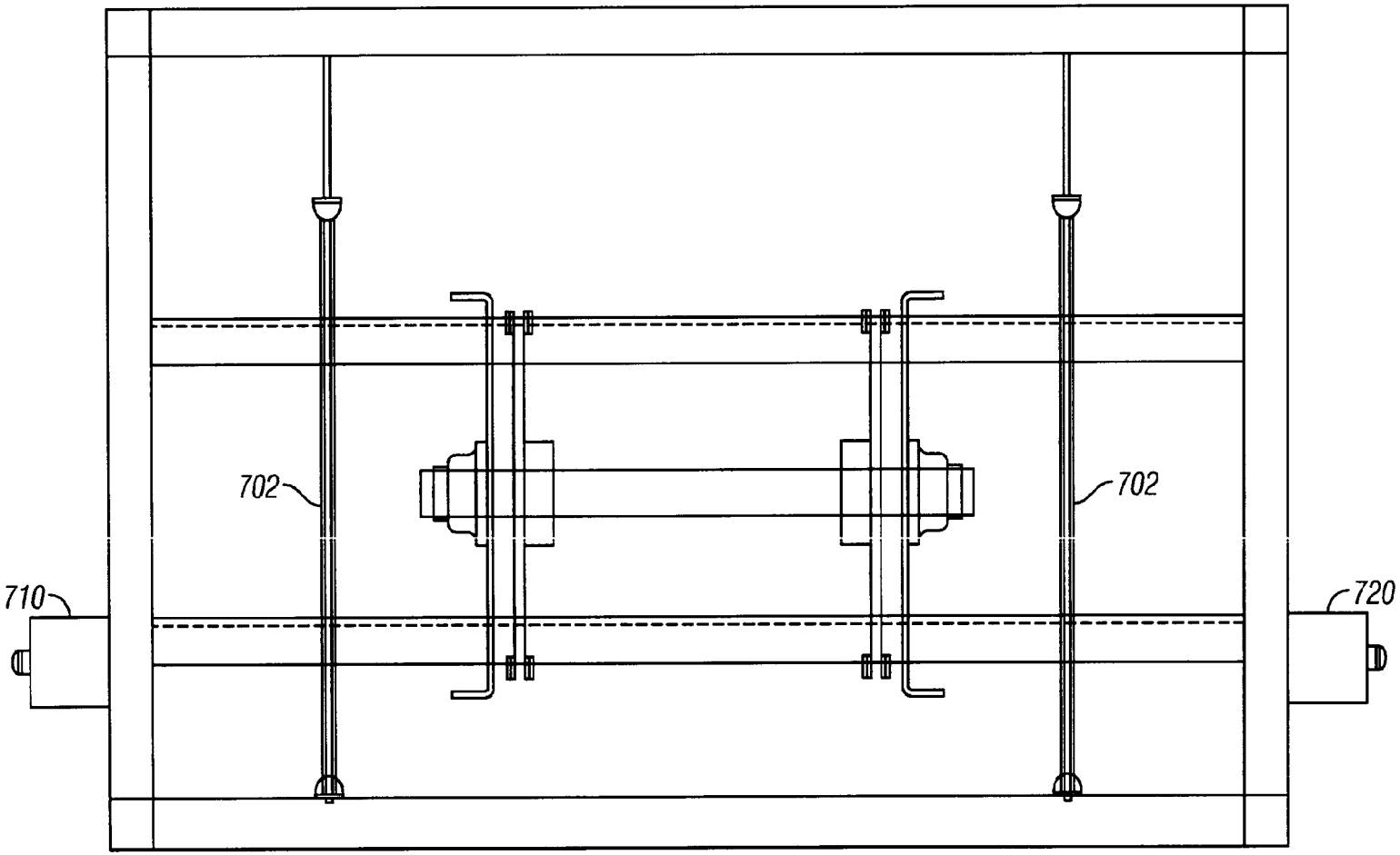
FIG. 7 shows a top view of the conveyor.

FIG. 7 shows a top view of the conveyor including two cables 700, 702. Emergency stop buttons 710 and 720 are located on opposite sides of the table.

FIGS. 8A, 8B, 9A and 9B illustrate a more detailed view of the cable gripper. The cable gripper is formed of a first holding piece and a second holding piece 800, 805. The gripper 145 rides on, and moves along, an edge surface 811 of a support piece 810. For example, the support piece 810 can be an "I beam", and the edge surface 811 can be the portion of the I beam that is substantially perpendicular to the main support piece.

Figure 8A:
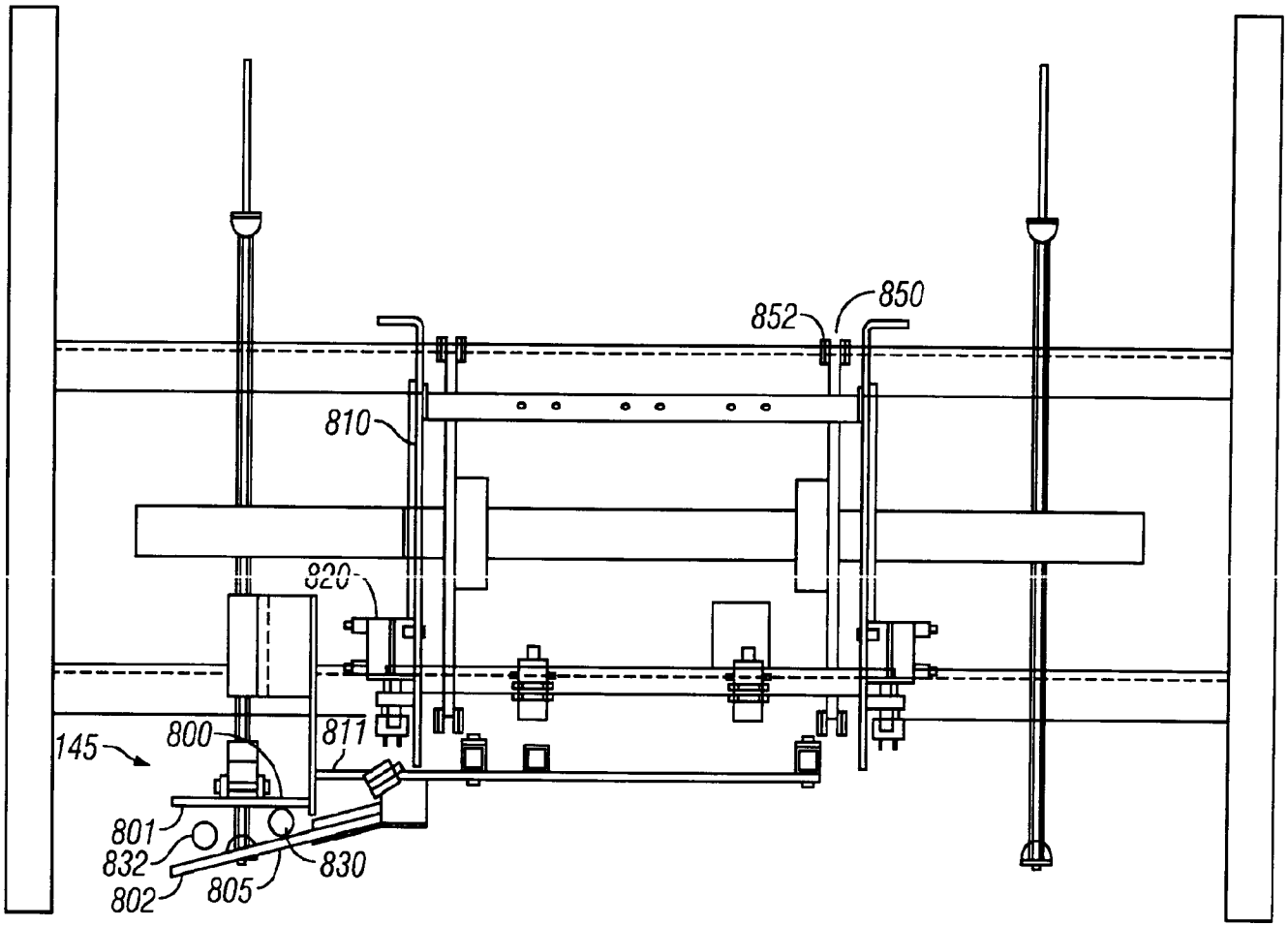
FIG. 8 shows a detailed view of the cable gripper.
Figure 8B:
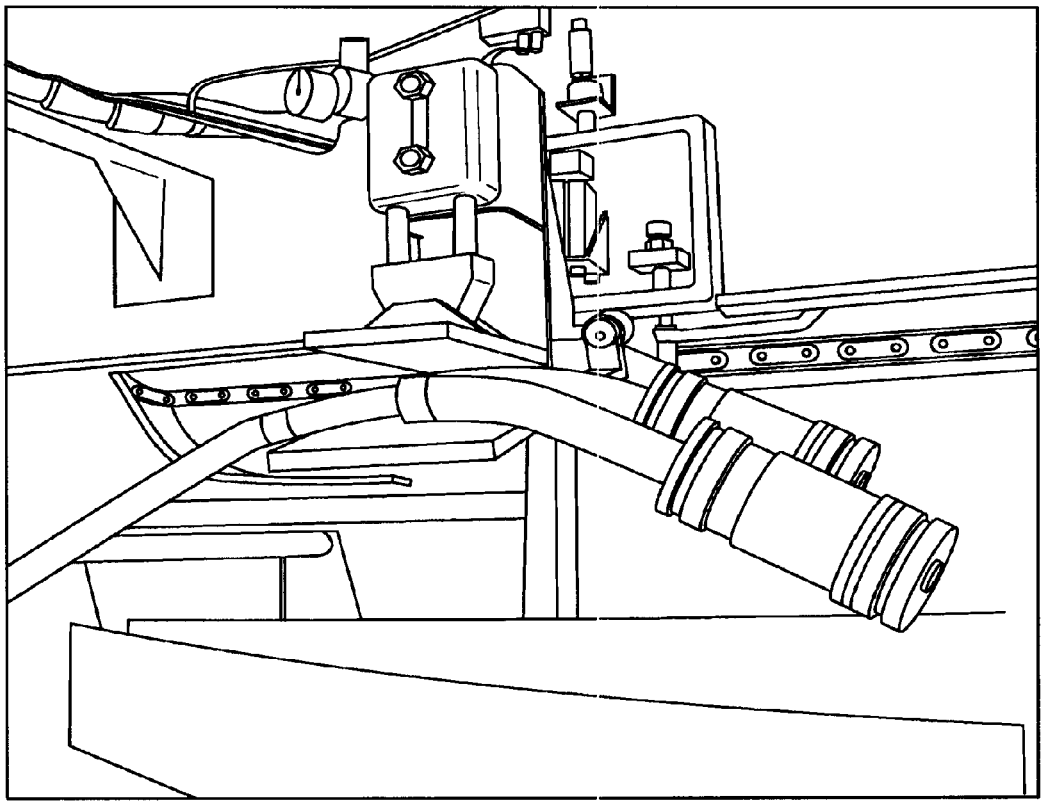
Figure 9A:
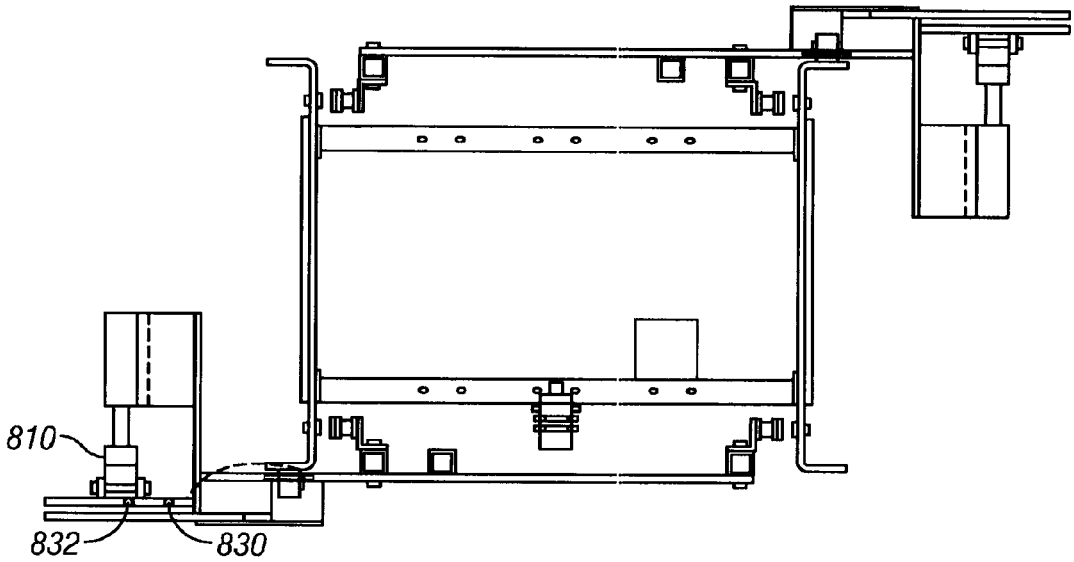
FIG. 9 shows the cylinder in its closed position.
Figure 9B:
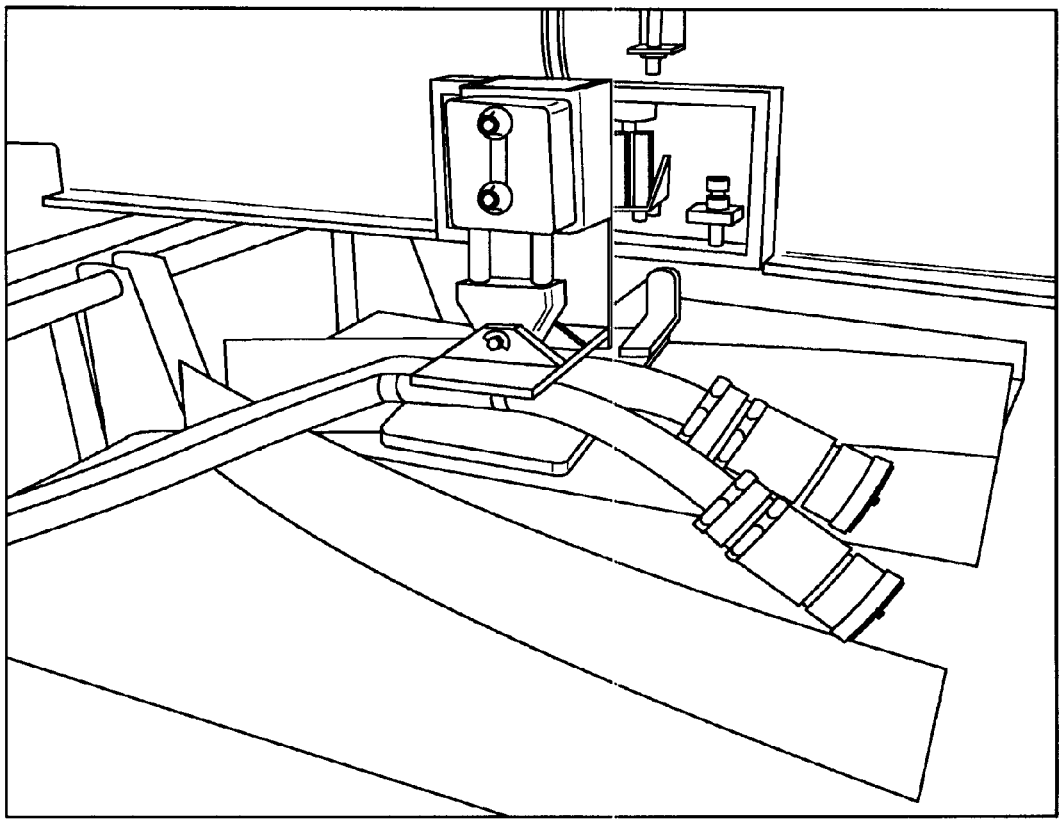

The two pieces 800, 805 are opened by the movement of a linear driving part such as piston 820. This causes the bottom piece 805 to tilt downward, opening the area between the top and bottom pieces. FIG. 8A and 8B illustrate the pieces 800, 805 in their open position. In this position, the cables 830, 832 can be inserted therein. FIGS. 9A and 9B illustrate the cylinder in its closed position, with two cables, 830 and 832, held between the two gripper parts 800, 805. In this way, a number of cables of similar sizes can all be held by the same device. The opening and closing can be via an air operated part, such as an air piston, the device in essence self-adjusts—closing with a certain amount of force to thereby hold the cables of any size automatically. Note that the cables are held between a first movable surface 801 that is controlled by the piston 820, and a second surface 802. The second surface may also move against a spring force. Accordingly, any size cable can be held by the gripper.

The gripper assembly itself is connected to a carriage 850 but moves on rollers 852 along the conveyor.

In an embodiment, a foot pedal may be provided that allows the operator to press the foot pedal to raise the first movable surface, after which the cables are placed into position, and the foot pedal is released to lower the first movable surface.

Figure 10:
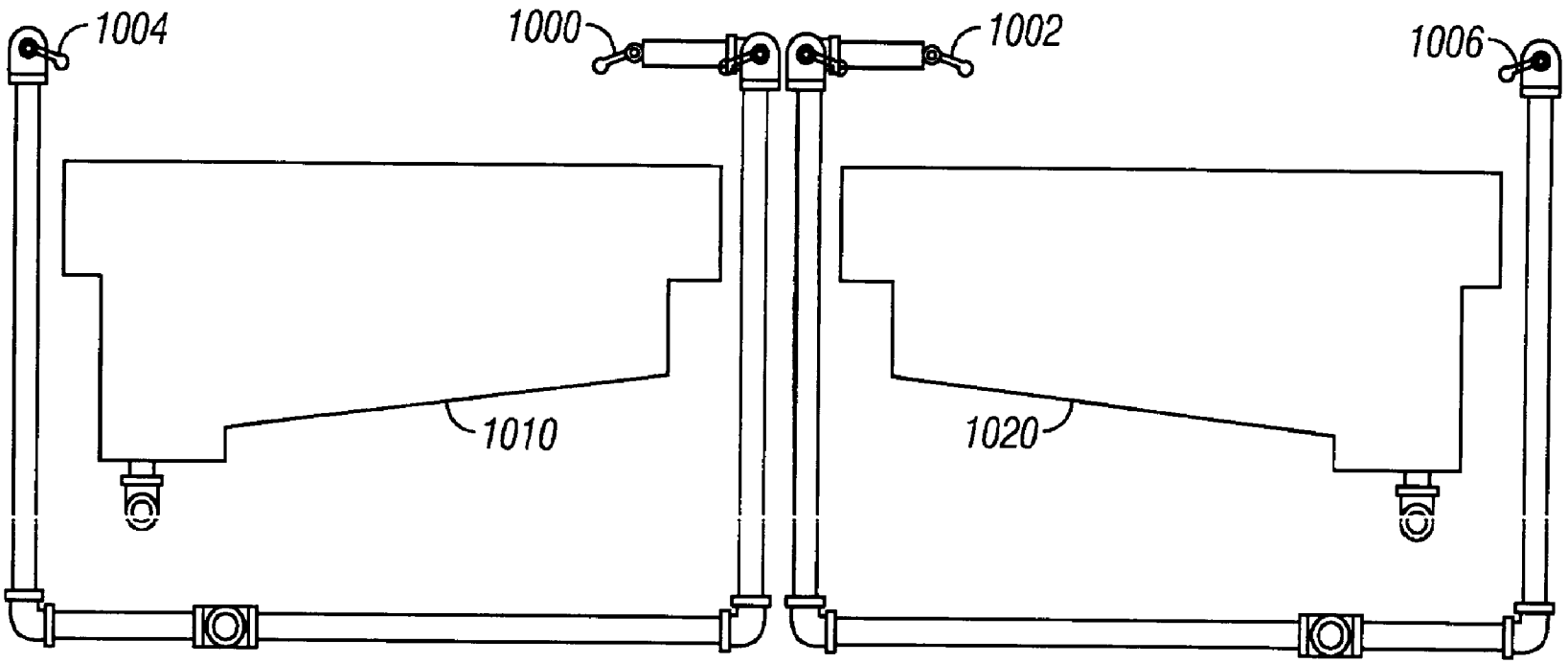
FIG. 10 shows a cross-section of the conveyor.
Figure 11:
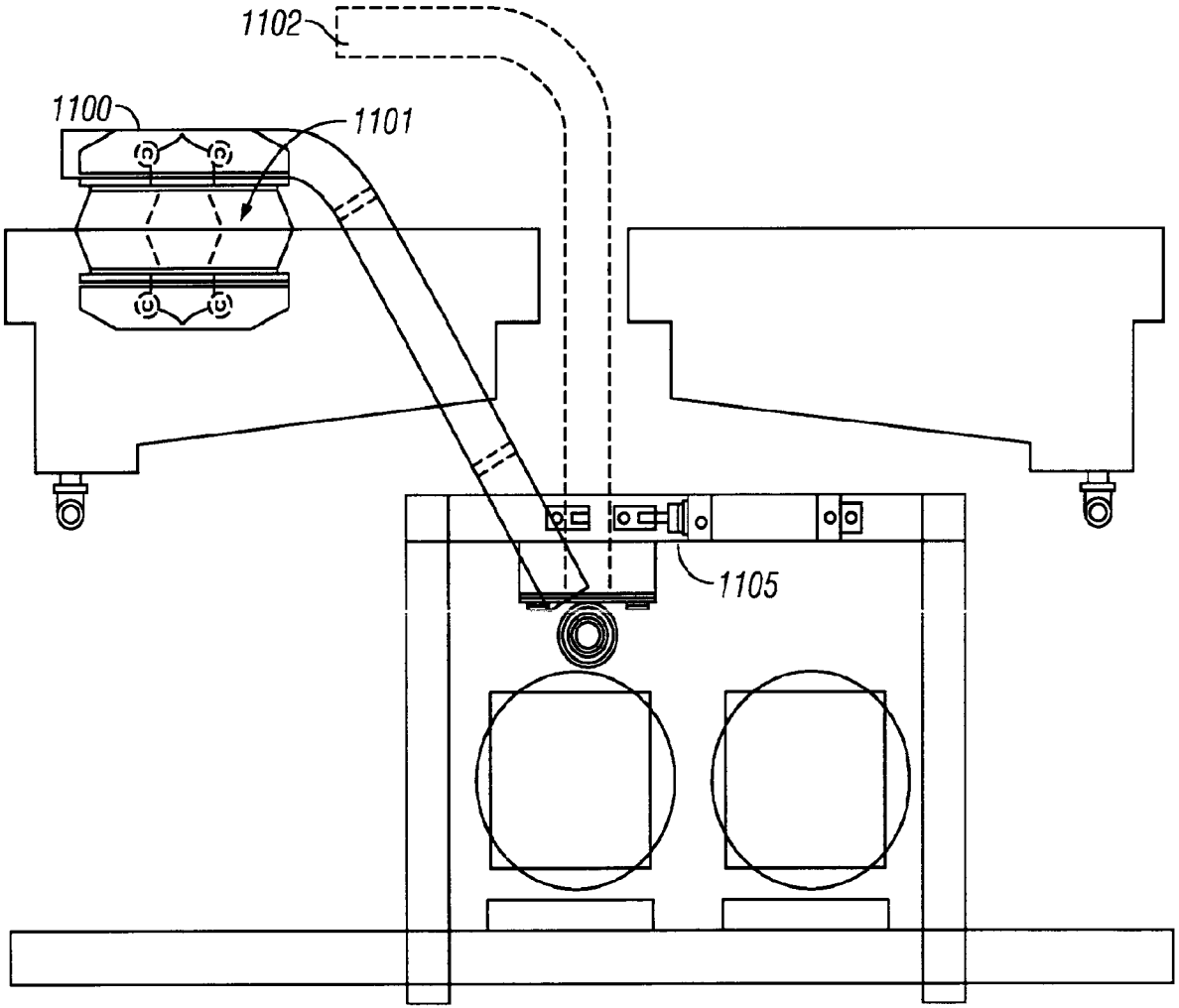
FIG. 11 shows the brushes on the conveyor.

An important feature of this system is that pans and troughs may be located under the device to catch runoff. FIG. 10 illustrates a cross-section along the line 10-10 in FIG. 5. This shows, for example, how the presoak nozzles 1000, 1002, 1004, 1006 can be used to spray presoak water onto the cables. Drain pans 1010 and 1020 are located under this area of the conveyor, to capture the overflow water. The brushes are shown in FIG. 11, where brushes are formed in an area so that the cable needs to pass between the brushes. In the area of the brushes 1100, there may be splash guards 1102 to prevent the water from splashing. The brushes 1100 have indentations which are intended to provide additional surfaces for cleaning the cable. A piston drives the position of the brushes.

Figure 12:
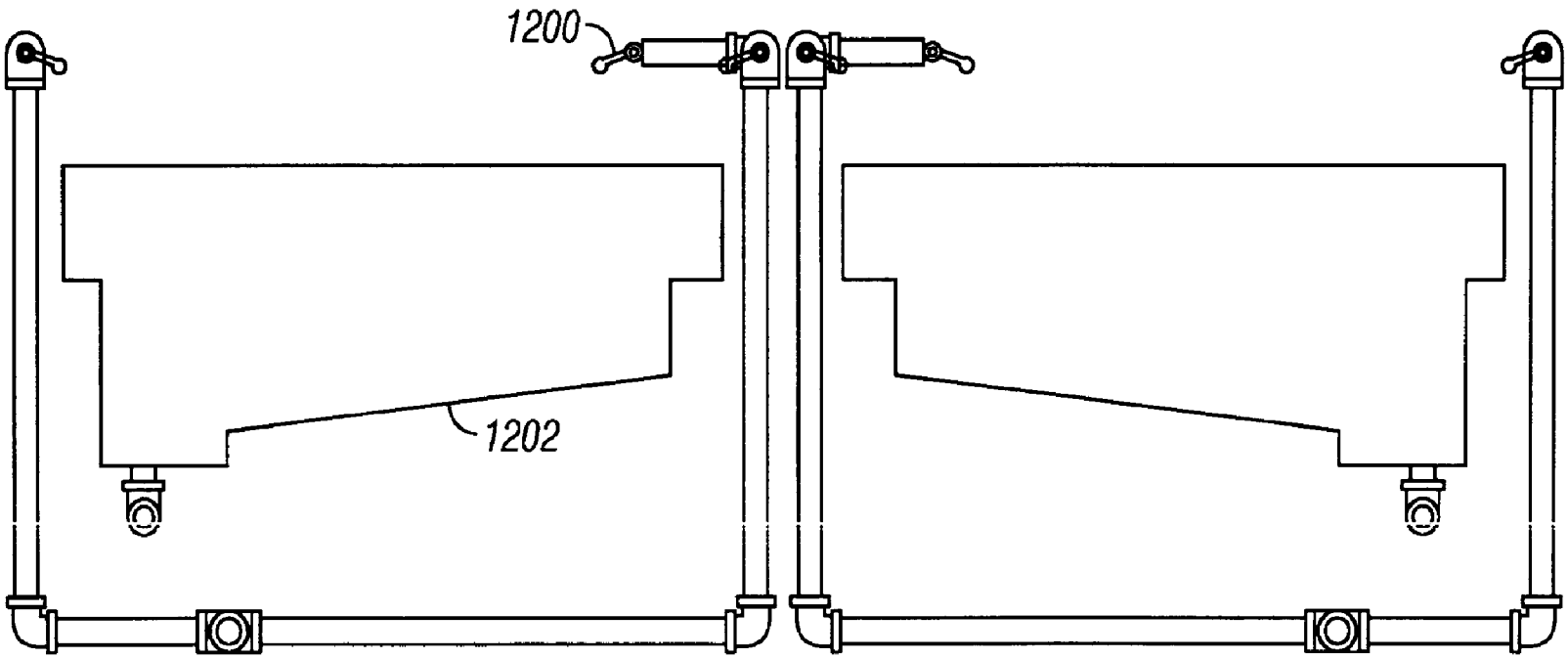
FIG. 12 shows a side view of the rinsing station.

FIG. 12 illustrates a side view of the rinsing station, again with nozzles such as 1200, and splash areas 1202.

This structure allows the cable to be pulled and washed at the same time. All customer markings can be removed by washing, as well as dirt and the like. An automatic release system allows the end of the cable to be released once the cable end reaches the correct area. An automatic bundling system may be used at that area.

The printer may print a barcode that is associated with the cable, and which states characteristics of the cable. After bundling the cable, a barcode may be scanned into an inventory management system, which indicates that a bundle, having those specific characteristics, is ready to rent. The cable is then placed on pallets for storage, for example, and when rented, the barcode is scanned again, removing the cable from inventory.

In operation, operators may be on each side of the conveyor. A conveyor button may be pressed when the conveyor is ready for work. The next available cable gripper opens automatically, on the side of the operator where the conveyor button was pressed. The operator inserts the cable into the open gripper area, and then presses a pre-start part, for example a prestart switch on the floor, to close the gripper. As a safety measure, the operator may be forced at that point to press either a wash, or a pass selector switch to start the operation. The wash switch causes the cables to be washed, by raising the brushes via the piston 1105, while the pass switch just passes the cables without washing.

The cable, while gripped, is passed through the washer area. Depending on the buttons which are pressed, either wash operations or no wash operations is performed. If wash has been selected, a selected sensor will read the cable gripper and start a wash cycle.

The different structure shown along the conveyor includes a prewash cycle which begins using a water and soap solution. The cable is then passed through foam brushes where one brush moves over the cable, and a second brush moves up from the bottom. The cable is then rinsed with water, and finally passes through an air blower area. Cable droop may prevent some part of the cable from being washed.

When the cable reaches the end of the conveyor, the clamping device automatically releases the cable at the discharge area via the unclamping ramp in the area 510.

In one embodiment, emergency stop buttons are mounted in each corner of the conveyor, near each location where a worker might be located. Pressing any of the emergency stop buttons causes all equipment functions to stop.

The general structure and techniques, and more specific embodiments which can be used to effect different ways of carrying out the more general goals are described herein.

Although only a few embodiments have been disclosed in detail above, other embodiments are possible and the inventor(s) intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other kinds of bundling can be used.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The computer may be a Pentium class computer, running Windows XP or Linux, or may be a Macintosh computer. The computer may also be a handheld computer, such as a PDA, cellphone, or laptop.

The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

What is claimed is:

1. A cable pulling device, comprising:

a conveyor portion, which continually moves in a specified direction, said conveyor device having a first portion with a gripping part adapted to grip a portion of a cable, and at least one portion along the conveyor device that processes at least one aspect of the cable as it is pulled therethrough, and also having a release portion that allows releasing the cable from the conveyor portion at a releasing area; and an I-shaped beam on which the gripper part is moved, where the first portion attaches to and moves relative to, an edge surface which extends perpendicular to a support portion of said I shaped beam.

2. A device as in claim 1, further comprising a spooling portion, located at the releasing area, and operable to spool the cable that is removed from said releasing area.

3. A device as in claim 1, wherein said at least one portion includes a cable washing station.

4. A device as in claim 3 wherein said cable washing station includes at least one brush having a shape that is adapted for washing an exterior portion of the cable.

5. A device as in claim 3, wherein said cable washing station includes a water and soap applying station, and a water applying rinse station.

6. A device as in claim 3, further comprising a drying station.

7. A device as in claim 4, further comprising a pre-soak which wets the cable prior to its reaching said cable washing station, and at least one soap nozzle that sprays soap on the cable after said presoak station.

8. A device as in claim 3, wherein said cable washing station includes at least one meshed surface on which the cable is pulled, and at least one drain pan, located under the meshed surface, to receive water from a washing operation.

9. A device as in claim 1, further comprising at least one meshed surface on which the cable is pulled, a drain pan, located under said conveyor portion, and located to receive items which drain off the cable into said drain pan.

10. A device as in claim 3, further comprising a control for the cable washing station, which controls whether the cables are washed or not washed.

11. The device as in claim 1, wherein said first portion has a gripping part for two cables, to hold two cables to be simultaneously conveyed via said conveyor.

12. A device as in claim 3, wherein said first portion has a gripping part for two cables, causing two cables to be simultaneously conveyed via said conveyor, and wherein said cable washing station includes parts for washing said cables simultaneously.

13. The device as in claim 11, wherein said gripping part includes a first movable pressing surface, and a second pressing surface, wherein said first movable pressing surface presses against said second surface and holds at least one cable between said first and second surfaces.

14. The device as in claim 13, further comprising a fluid operated device, moving said first movable surface to press against said second surface, and to hold the cables once placed therein.

15. The device as in claim 14, wherein said second surface is also moved by said fluid.

16. The device as in claim 13, further comprising a cable carrying assembly, coupled to said gripping part, said cable carrying assembly mounted on rollers and moved along the conveyor assembly.

17. A device as in claim 1, wherein said conveyor assembly defines a returning path, wherein there are multiple of said first portions, and they are located at every specified distance along the conveyor assembly, and move along said path, first moving in a first direction to stretch cables, and then returning back to an origin.

18. A cable pulling device, comprising: a conveyor portion, which continually moves in a specified direction, said conveyor device having a first portion with a gripping part adapted to grip a portion of a cable, and at least one portion along the conveyor device that processes at least one aspect of the cable as it is pulled therethrough, and also having a release portion that allows releasing the cable from the conveyor portion at a releasing area , wherein said conveyor assembly defines a returning path, wherein there are multiple of said first portions, and they are located at every specified distance along the conveyor assembly, and move along said path, first moving in a first direction to stretch cables, and then returning back to an origin , wherein said conveyor assembly comprising an I-shaped beam on which the gripper part is moved, where the gripper part attaches to and moves relative to, an edge surface which extends perpendicular to a support portion of said I shaped beam, and has rounded areas at both its ends.

19. A cable pulling device, comprising: a conveyor portion, which continually moves in a specified direction, said conveyor device having a first portion with a gripping part adapted to grip a portion of a cable, and at least one portion along, the conveyor device that processes at least one aspect of the cable as it is pulled therethrough, and also having a release portion that allows releasing the cable from the conveyor portion at a releasing area;

a spooling portion, located at the releasing area, and operable to spool the cable that is removed from said releasing area; and a printer located adjacent the spooling portion, and enabling printing a sticker to be placed on the cable.

20. A device as in claim 19, wherein said at least one portion includes a washing and drying station that washes and dries the cable.

21. A cable handling device, comprising: a conveyor, formed of a support beam with a conveying surface; a plurality of cable gripping portions, coupled to said conveying surface, said cable gripping portions being extendable into a first position to allow placing a cable therein, and closed into a second position to hold a cable which has been placed therein, said cable held relative to said gripping portions; a movable carriage, coupled to said gripping portions, movable along with said conveying surface; at least one washing station, adjacent a first area of said conveyor, said washing station including at least one washing part, and at least one part below said conveyor receiving run off from the washing part; at least cable receiving device, located adjacent said conveyor, at a location after said washing station has washed said cable, receiving a cable that is released from said cable gripping portions, wherein said conveyor comprises an I-shaped beam on which the cable gripping portions are moved, where the cable gripping portions attach to and move relative to, an edge surface which extends perpendicular to a support portion of said I shaped beam, and wherein said I shaped beam has rounded areas at both its ends along which a movable carriage can be moved cable gripping portion holds multiple cables.

22. A device as in claim 21, wherein said washing station includes a presoak part which first presoaks the cable, a washing part including one brush that washes the cable, a rinsing part, that reduces the washed cable, and a drying part that drives the cable after said rinsing part.

23. A device as in claim 21, further comprising plural operator stations that allow an operator to carry out at least one operation along the conveyor, and at least one emergency stop control adjacent to each of said operator stations.

24. A device as in claim 21, further comprising a control for a washing station, which controls in a first state the cables to be washed, and in a second state for the cables to be not washed.

* * * * *